US009586101B2

(12) United States Patent
Motokawa

(10) Patent No.: US 9,586,101 B2
(45) Date of Patent: Mar. 7, 2017

(54) GOLF CLUB

(71) Applicant: DUNLOP SPORTS CO. LTD., Kobe-shi, Hyogo (JP)

(72) Inventor: Yuki Motokawa, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 208 days.

(21) Appl. No.: 14/305,505

(22) Filed: Jun. 16, 2014

(65) Prior Publication Data

US 2015/0005097 A1 Jan. 1, 2015

(30) Foreign Application Priority Data

Jun. 27, 2013 (JP) ..... 2013-135320

(51) Int. Cl.
*A63B 53/06* (2015.01)
*A63B 53/04* (2015.01)
*A63B 53/02* (2015.01)

(52) U.S. Cl.
CPC ..... *A63B 53/0466* (2013.01); *A63B 53/04* (2013.01); *A63B 53/02* (2013.01); *A63B 53/06* (2013.01); *A63B 2053/0433* (2013.01); *A63B 2053/0491* (2013.01)

(58) Field of Classification Search
CPC .... A63B 2053/0491; A63B 2053/0433; A63B 53/06; A63B 53/02
USPC ..... 473/338, 309, 334, 335, 344, 349, 341
See application file for complete search history.

(56) References Cited

U.S. PATENT DOCUMENTS 4,655,459 A * 4/1987 Antonious ..... A63B 53/0487 473/338
2009/0264214 A1* 10/2009 De La Cruz ..... A63B 53/02 473/307
2012/0071261 A1 3/2012 Yamamoto

FOREIGN PATENT DOCUMENTS

JP 2012-86010 A 5/2012

* cited by examiner

*Primary Examiner* — Benjamin Layno
(74) *Attorney, Agent, or Firm* — Birch, Stewart, Kolasch & Birch, LLP

(57) ABSTRACT

A golf club includes a golf club head provided with a first hole and a second hole on its bottom side, a shaft detachably fixed to the golf club head, a weight member comprising a first weight member and a second weight member each detachably fixed to the golf club head, and a faster including a first fastener for fixing the shaft and the first weight member to the golf club head through the first hole, and a second fastener for fixing the second weight member to the golf club head through the second hole. The first weight member and the second weight member are configured as mutually replaceable weights so that the first weight member is fixed to the second hole using the second fastener and the second weight member is fixed to the first hole using the first fastener.

9 Claims, 5 Drawing Sheets

GOLF CLUB

BACKGROUND OF THE INVENTION

Field of the Invention

The present invention relates to a golf club including a golf club head, a shaft detachably attached to the golf club head, and a detachable weight member for the golf club head, and in particularly to a golf club that may flexibly adjust a location of the center of gravity of the golf club head.

Description of the Related Art

The Japanese Unexamined Patent Application Publication No. 2012-86010 discloses a golf club including a golf club head and a shaft detachably attached thereto. The golf club, for instance, includes a hosel having a shaft insertion hole having an upper opening into which the shaft is inserted. The shaft insertion hole further has a lower opening as a first hole where a fastener for fixing the shaft to the golf club head is fastened. The golf club described above has advantage of offering an opportunity to exchange the shaft or club head by the golfer.

SUMMARY OF THE INVENTION

The present invention has a main object of providing a golf club having a feature for adjusting the location of center of gravity of the golf club head without deteriorating flexibility in the design of the club head.

According to one aspect of the invention, a golf club includes a golf club head provided with a first hole and a second hole on its bottom side, a shaft detachably fixed to the golf club head, a weight member comprising a first weight member and a second weight member each detachably fixed to the golf club head, and a faster including a first fastener for fixing the shaft and the first weight member to the golf club head through the first hole, and a second fastener for fixing the second weight member to the golf club head through the second hole. The first weight member and the second weight member are configured as mutually replaceable weights so that the first weight member is fixed to the second hole using the second fastener and the second weight member is fixed to the first hole using the first fastener.

According to another aspect of the invention, the first fastener and the second fastener may be configured as mutually replaceable fasteners so that the first fastener fixes the second weight member through the second hole and the second fastener fixes the first weight member and the shaft through the first hole.

According to another aspect of the invention, the golf club head may further comprise a hosel provided with a shaft insertion hole that comprises an upper opening for insertion of the shaft into the golf club head, and a lower opening that opens on the bottom side, a shaft sleeve adaptor attached to a tip end of the shaft and having a threaded hole extending toward the shaft from a bottom thereof, and the first hole comprising a space extending upwardly from the lower opening of the shaft sleeve adaptor toward the threaded hole of the shaft sleeve adaptor.

According to another aspect of the invention, each of the first weight member and the second weight member may have a through hole for insertion of the first and second fastener.

According to another aspect of the invention, the first weight member may be fixed between the shaft sleeve adaptor and the first fastener.

According to another aspect of the invention, each of the first weight member and the second weight member may comprise a plurality of weight pieces.

According to another aspect of the invention, one of the weight pieces of the first weight member may be replaceable to one of the weight pieces of the second weight member.

According to another aspect of the invention, at least one of the first weight member and the second weight member may comprise a pair of weight pieces that have the same shape but different in mass.

According to another aspect of the invention, a plurality of the weight pieces of the first weight member may be replaceable to a plurality of the weight pieces of the second weight member.

According to another aspect of the invention, the first fastener may have mass different from that of the second fastener.

According to another aspect of the invention, at least one of the first weight member and the second weight member may comprise a pair of weight pieces that have the same shape and size but different in mass.

In accordance with the present invention, the golfer may exchange the positions of the first weight member and the second weight member. In other words, the first hole for attaching the shaft to the club head may be used as a hole for attaching the first or second member to adjust the center of gravity of the club head. Thus, the present invention may offer a golf club that may offer the weight adjustment feature of the club head and a shaft detachable feature while reducing the number of second holes for attaching the weight member on its bottom side so that flexibility in the design of the club head is improved.

DETAILED DESCRIPTION

An embodiment of the present invention will be explained below with reference to the accompanying drawings.

Figure 1:
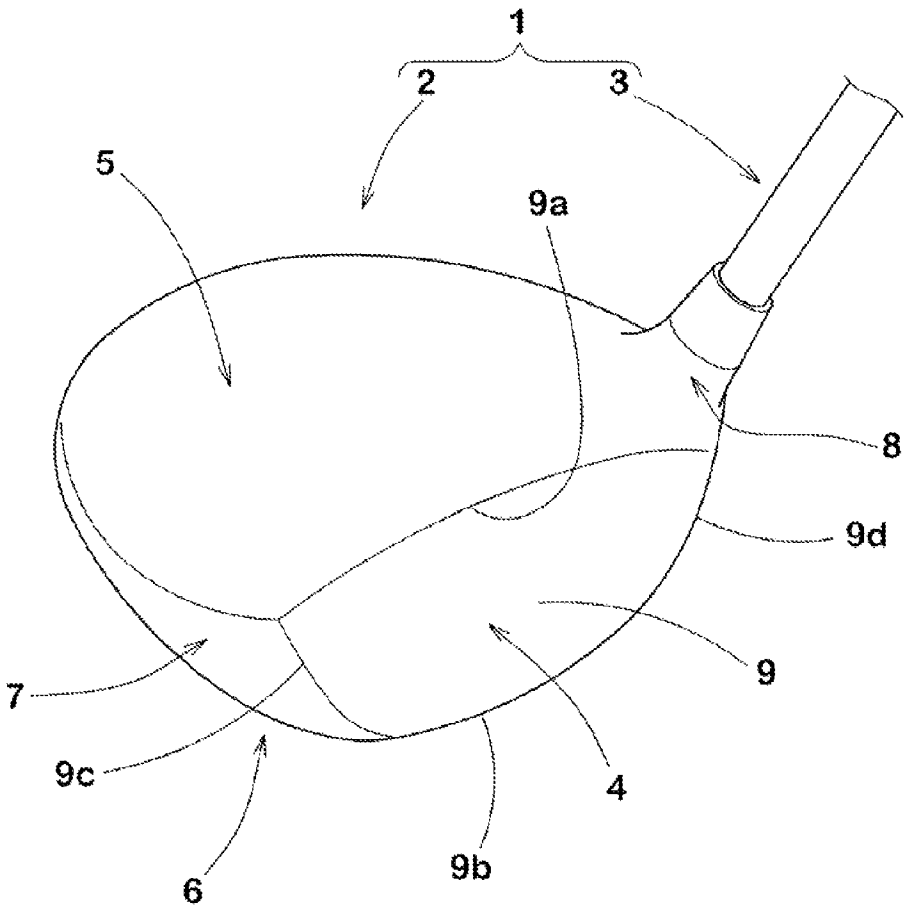
FIG. 1 is a perspective view illustrating a golf club in accordance with an embodiment of the present invention.

FIG. 1 is a perspective view illustrating a golf club 1 in accordance with an embodiment of the present invention. The golf club 1 includes a golf club head (which may be hereinafter simply referred to as a "head") 2, and a shaft 3 that is detachably attached to the golf club head 2.

The head 2 in accordance with the present embodiment is configured as a wood type having a hollow (i) (shown in FIG. 2) provided therein. A concept of a wood-type golf club head is such that it includes at least Driver (#1), Brassy (#2), Spoon (#3), Baffy (#4), and Cleek (5), and also includes heads which differ from them in the count number or a name but has an almost similar shape thereto. In another aspect of the present invention, the head 2 may be configured as an iron-type, a utility-type, or a putter-type.

The major part of the head 2 is preferably made of a metal material such as stainless steel, maraging steel, titanium, titanium alloy, magnesium alloy or aluminum alloy. For the head 2, plurality kinds of metal materials may be used. The head 2 may be partially made of a non-metal material such as fiber reinforced resin.

Referring back to FIG. 1, the head 2 includes a face portion 4, a crown portion 5, a sole portion 6, a side portion 7, and a hosel 8.

The face portion 4 includes a hitting face 9 for striking a golf ball. The hitting face 9 has an upper edge 9*a*, a lower edge 9*b*, a toe-side edge 9*c*, and a heel-side edge 9*d*. The crown portion 5 extends rearward from the upper edge 9*a* of the hitting face 9 so as to form a top surface of the head 2. The sole portion 6 extends rearward from the lower edge 9*b* of the hitting face 9 so as to form a bottom surface of the head 2. The side portion 7 extends from the toe-side edge 9*c* of the hitting face 9 to the heel-side edge 9*d* of the hitting face 9 through a rear of the head in between the crown portion 5 and the sole portion 6. Regarding the front-rear direction of the head 2, the front of the head 2 means the side which is near the hitting face 9, and the rear means the side apart from the hitting face 9.

Figure 2:
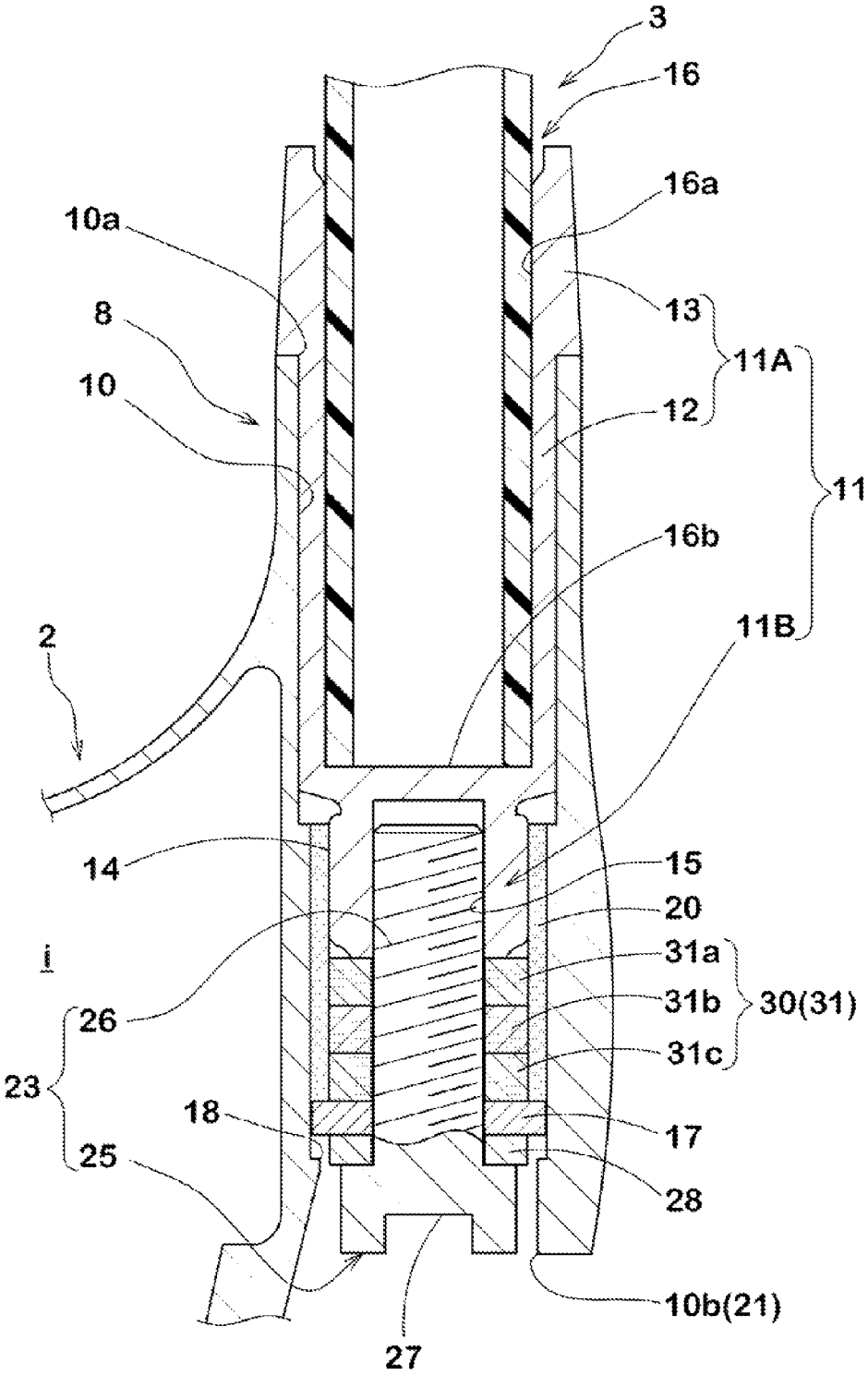
FIG. 2 is a cross-sectional view of a connected portion of a golf club head and a shaft.

The hosel 8 is provided on the heel side of the crown portion 5. FIG. 2 illustrates the cross-sectional view of the hosel 8. The hosel 8 is formed into a tubular (cylindrical) shape having a shaft insertion hole 10. The shaft insertion hole 10 is a through hole that comprises an upper opening 10*a* for insertion of the shaft 3 into the head 2, and a lower opening 10*b* that opens on the sole portion 6 (shown in FIG. 1).

In the shaft insertion hole 10, a support pipe 20 made of metal material is bonded by welding, for instance. The support pipe 20 comprises an outer surface fitted on the shaft insertion hole 10, and an inner surface being alternately provided with ridges and grooves that extend in an axial direction of the tube to form splines.

Below the support pipe 20, a plane washer 17 is disposed. The plane washer 17 is held with a gap in a space between the bottom end of the support pipe 20 and an internal flange 18 protruding radially inward of the shaft insertion hole 10, thereby preventing from falling off the plane washer 17 from the head 2.

The shaft 3 is made of a fiber reinforced plastic, for instance. The shaft 3 is formed into a pipe shape having a tip end to which a shaft sleeve adaptor 11 is attached.

The shaft sleeve adaptor 11 is made of a metal material. The shaft sleeve adaptor 11 comprises a sleeve body 11A into which the shaft 3 is inserted, and an axial portion 11B connected below the sleeve body 11A.

The sleeve body 11A is formed into a pipe shape that has an axially extending bore 16. The bore 16 is configured as an upper opened hole defined by an inner surface 16*a* and a closed bottom surface 16*b*. The shaft 3 is previously bonded to the bore 16 by using adhesive agent, for example. The sleeve body 11A integrally includes a first portion 12 inserted into the hosel 8, and a second portion 13 exposed outside the hosel 8. The second portion 13 includes a conical outer surface having a diameter for engaging the top of the hosel 8.

The shaft sleeve adaptor 11 with the shaft 3 is inserted in the shaft insertion hole 10 of the hosel 8 from the upper opening 10*a*. Thus, the shaft 3 is assembled to the head 2. Since the second portion 13 of the sleeve body 11A may engage with the top of the hosel 8, the shaft sleeve adaptor 11 stays a certain position when it is inserted.

The axial portion 11B of the shaft sleeve adaptor 11 has an outer surface provided with splines 14, and an inner surface provided with a threaded hole 15.

The splines 14 alternately include axially extending ridges and grooves in a circumferential direction of the axial portion 11B. The splines 14 of the shaft sleeve adaptor 11 may engage with the splines of the inner surface of the support pipe 20. Thus, the shaft sleeve adaptor 11 with the shaft 3 is fixed to the head 2 without turning around the central axis thereof.

The threaded hole 15 extends from a bottom of the axial portion 11B toward the shaft 3.

Figure 3:
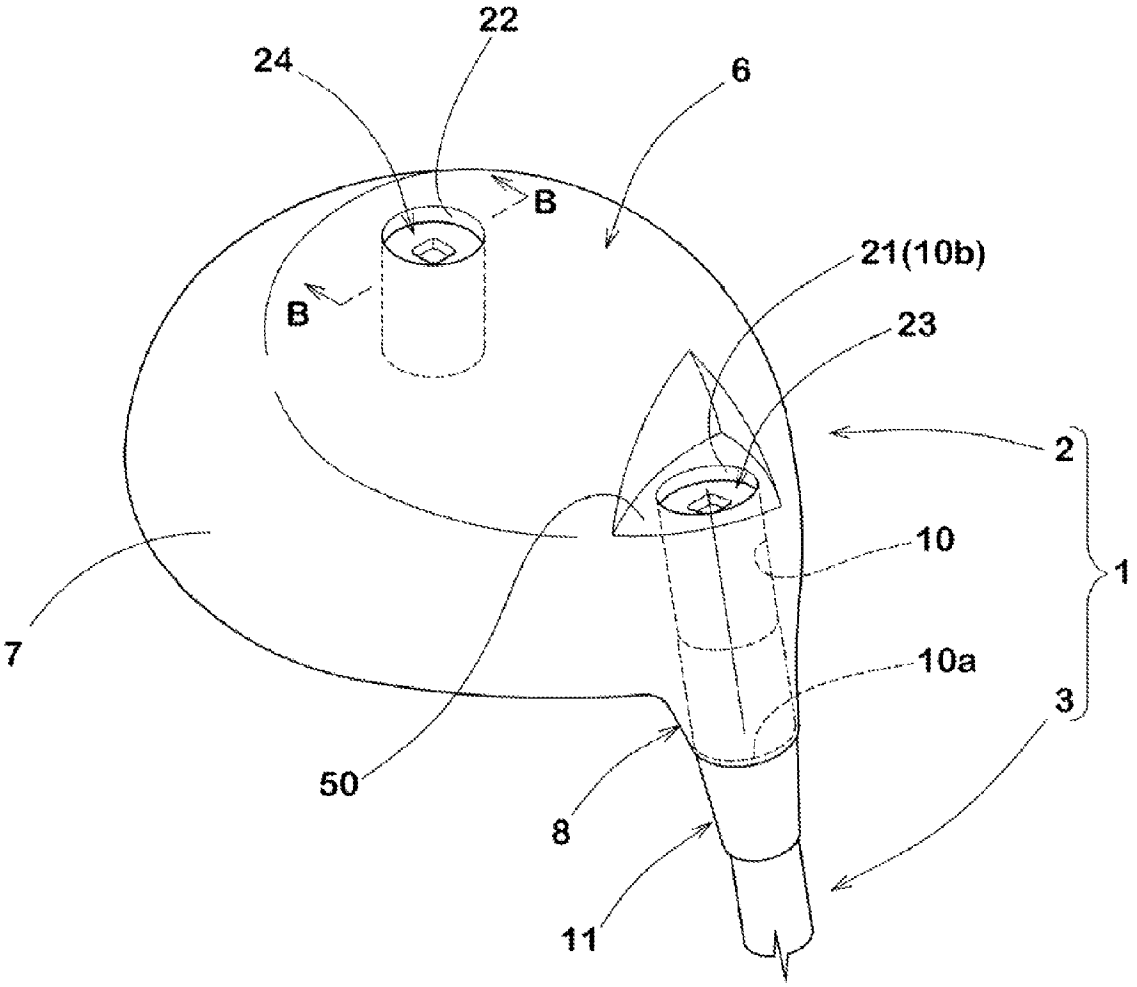
FIG. 3 is a perspective view of the golf club viewed from a bottom side of the golf club head.
Figure 4:
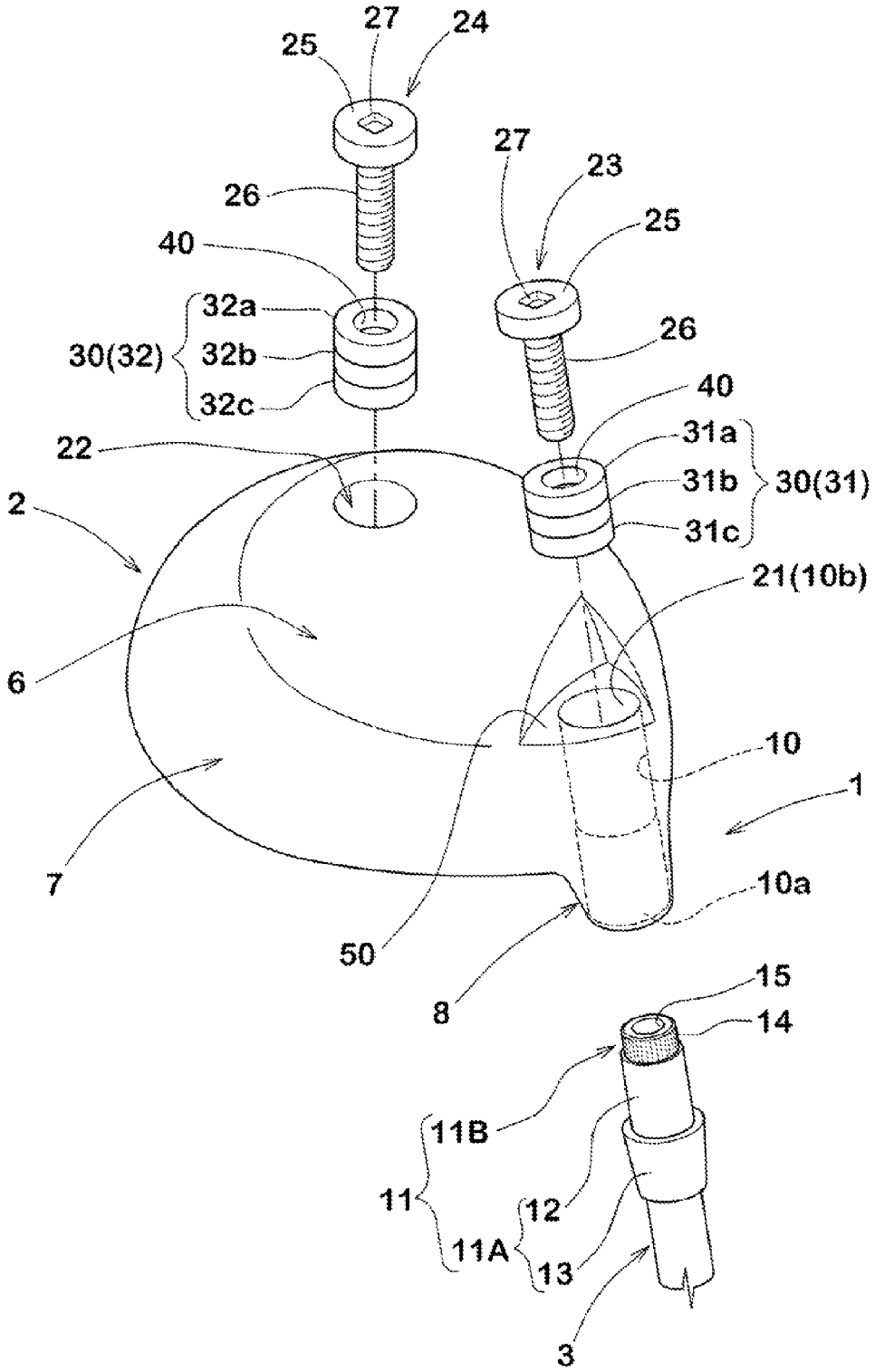
FIG. 4 is an exploded perspective view of the golf club of FIG. 3.

FIG. 3 illustrates a perspective view of the golf club 1 viewed from a bottom side of the golf club head, and FIG. 4 illustrates an exploded perspective view of FIG. 3. As shown in FIGS. 2 to 4, the head 2 is provided on the bottom side with a first hole 21 and a second hole 22.

Referring to FIGS. 2 and 3, the first hole 21 is configured as a space extending upwardly from the lower opening 10*b* of the shaft insertion hole 10 toward the threaded hole 15 of the shaft sleeve adaptor 11. Thus, the first hole 21 is provided at the heel side of the head 2. As shown in FIG. 4, the sole portion 6 includes a recess 50 on its heel side where the first hole 21 in accordance with the present embodiment is provided.

The second hole 22, for instance, is provided on the toe side of the head. Although one second hole 22 is provided in this embodiment, a plurality of second holes 22 may be provided if flexibility in the design of the head 2 allows it.

As shown in FIG. 4, the golf club 1 further includes a weight member 30 that is detachably attached to the head 2. The weight member 30 includes a first weight member 31 disposed in the first hole 21, and a second weight member 32 disposed in the second hole 22.

In the first hole 21, a first fastener 23 is fastened to fix the shaft 3 and the first weight member 31 to the head 2. In the second hole 22, a second fastener 24 is fastened to fix the second weight member 32 to the head 2.

In this embodiment, the first fastener 23 and the second fastener 24 have substantially identical bolt shape that includes a bolt head 25 and a threaded axial portion 26.

In one aspect of the embodiment, the first fastener 23 and the second fastener 24 may have the same mass. In another aspect of the embodiment, the first fastener 23 and the second fastener 24 may have different mass. In this embodiment, the first fastener 23 is made of a material having a specific gravity different from that of the second fastener 24 to provide different mass with respect to the second fastener 24. Preferably, the first and second fasteners 23 and 24 are made of a metal material such as stainless steel, titanium, aluminum alloy, copper alloy, or tungsten steel. A resin material may be used for the first fastener 23 or the second fastener 24.

The bolt head 25 is configured as a circular piece with a socket 27 on its top for fastening the shaft 3 to the club head 2 by a tool such as a wrench. Although the socket 27 is configured as a rectangular shape in this embodiment, any shape such as a hexagon and star-shape may be used.

In this embodiment, each of the first weight member 31 and the second weight member 32 is configured as a circular piece with a through hole 40 for insertion of the first fastener 23 or the second fastener 24. The first weight member 31 has mass different from that of the second weight member 32. Each of the first weight member 31 and the second weight member 32 comprises a plurality of weight pieces 31*a* to 31*c*, and 32*a* to 32*c*, respectively. In one aspect of the embodiment, the respective weight pieces 31*a*, 31*b*, 31*c*, 32*a*, 32*b*, and 32*c* are formed into an identical shape, but are made from materials different in specific gravity to provide different mass. In another aspect of the embodiment, the respective weight pieces 31*a*, 31*b*, 31*c*, 32*a*, 32*b*, and 32*c* are different at least in thickness to provide different mass.

As shown in FIG. 2, the first fastener 23 fixes the first weight member 31 and the shaft 3 to the head 2 through the first hole 21. For the preferable embodiment, a spring washer 28 is inserted between the plane washer 17 and the bolt head 25. In another aspect of the embodiment, the plane washer 17 may be replaced an internal flange integrally formed on the head 2.

While the first weight member 31, and the shaft sleeve adaptor 11 with the shaft 3 is inserted into the shaft insertion hole 10 from its upper opening 10*a*. The plane washer 17 receives the first weight member 31 so that the first weight member 31 stays in the shaft insertion hole 10.

The threaded axial portion 26 of the first fastener 23 passes through the spring washer 28, the plane washer 17, the first weight member 31, and then is screwed into the threaded hole 15 of the shaft sleeve adaptor 11. By screwing the first fastener 23 into the threaded hole 15 of the shaft sleeve adaptor 11, the shaft sleeve adaptor 11 is forced downwardly because the upward movement of the first fastener 23 is limited by the support pipe 20 fixed to the hosel 8. Thus, the shaft 3 is firmly fixed to the hosel 8 through the shaft sleeve adaptor 11 which is acted high friction force between the second portion 13 and the top of the hosel 8. Similarly, the first weight member 31 is firmly fixed between the shaft sleeve adaptor 11 and the first fastener 23.

By loosening and then removing the first fastener 23 from the threaded hole 15 of the shaft sleeve adaptor 11, the shaft sleeve adaptor 11 with the shaft 3 and the first weight member 31 are able to be detached from the shaft insertion hole 10 of the hosel 8 of the head 2. Accordingly, the golf club 1 in accordance with the present invention may be easily detached the shaft 3 and the first weight member 31 from the first hole 21 and exchanged them, by only an operation of fastening and releasing the first fastener 23.

Figure 5:
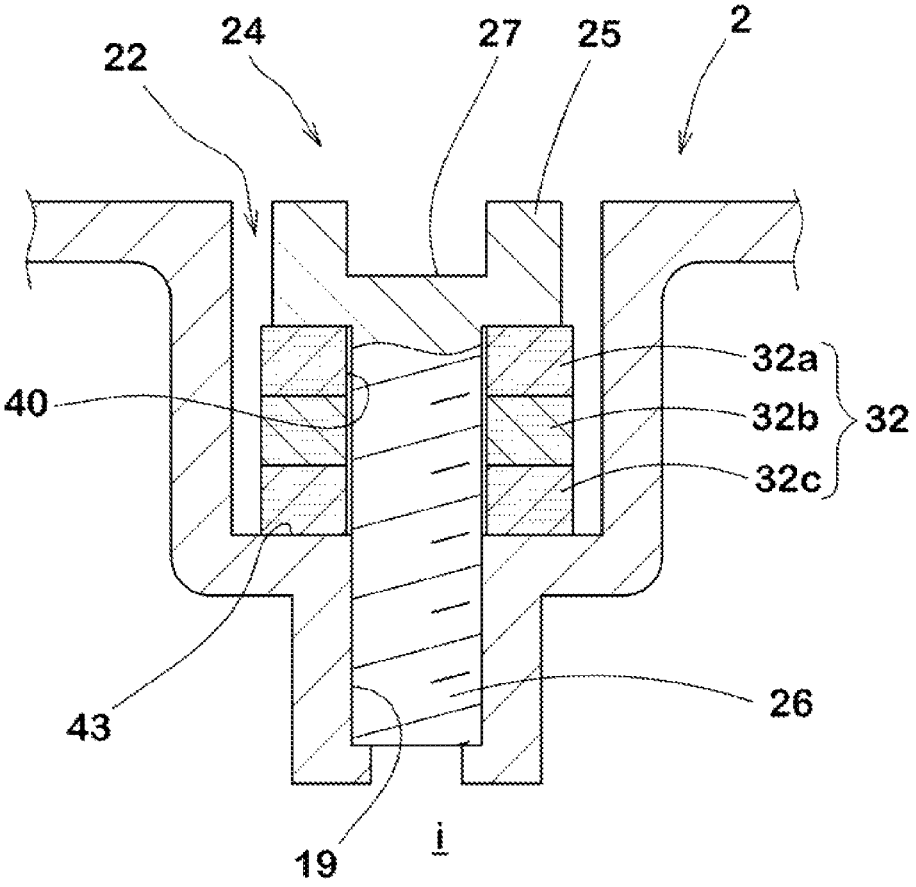
FIG. 5 is a cross-sectional view taken along line B-B in FIG. 3.

FIG. 5 illustrates a cross-sectional view taken along line B-B of FIG. 3. Referring to FIG. 5, the second fastener 24 is fastened to the second hole 22 to fix the second weight member 32 to the head 2.

The second hole 22 is configured as a recess 43 having a threaded hole 19 extending from its bottom to the hollow portion (i) of the head 2.

The second fastener 24 has the same configuration with the first fastener 23 described above. The second fastener 24 is fastened to the threaded hole 19 of the second hole 22 through the through hole 40 of the second weight member 32. Thus, the second weight member 32 is held and fixed between the bolt head 25 of the second fastener 24 and the bottom of the recess 43.

While, the second weight member 32 is able to be detached from the second hole 22 by removing the second fastener 24 from the threaded hole 19 of the second hole 22.

As described above, the golf club 1 in accordance with the embodiment of the present invention comprises the first weight member 31 that is able to be detached from the first hole 21. Then the first weight member 31 detached from the first hole 21 is able to be fixed to the second hole 22 by using the second fastener 24. Similarly, the second weight member 32 is able to be detached from the second hole 22. Then the second weight member 32 detached from the second hole 22 is able to be fixed to the first hole 21 by using the first fastener 23.

Accordingly, the first weight member 31 and the second weight member 32 are able to be exchanged the respective positions. In other words, the first hole 21 for attaching the shaft 3 to the head 2 may be used as a hole for attaching the first weight member 31 or second weight member 32 to adjust the location of the center of gravity of the head 2. Thus, the golf club 1 in accordance with the present embodiment may offer a feature for adjusting the center of gravity of the head 2 and a shaft detachable feature while reducing the number of second holes 22 for attaching the weight member on its bottom side so that the degree of freedom of designing of the head 2 is improved. These are very effective advantage regarding to a fairway wood type golf club that has a small volume head.

Furthermore, the second fastener 24 detached from the second hole 22 is able to use as a fastener that fixes the shaft 3 and the first weight member 31 to the first hole 21 of the head 2. On the other hand, the first fastener 23 detached from the first hole 21 is able to use as a fastener that fixes the second weight member 32 to the second hole 22. Thus, when the first and second fasters 23 and 24 have different mass, they also help to adjust the location of the center of gravity of the head by exchanging the positions each other.

In the preferable embodiment of the present invention, a plurality of first weight members 31 that have a respective different mass may be previously prepared. Then one of the first weight member 31 having a suitable mass chose by a golfer is able to be attached to the first hole 21. Similarly, a plurality of second weight members 32 that have a respective different mass may be previously prepared. Then one of the second weight member 32 having a suitable mass chose by a golfer is able to be attached to the second hole 22. Thus, the golfer may adjust the location of the center of gravity of the head according to his or her choice.

By exchanging the respective positions of the first and second weight members 31 and 32, the location of the center of gravity of the head 2 may be adjusted at least in a toe-heel direction of the head 2. On this occasion, one of the weight pieces 31*a* to 31*c* of the first weight member 31 is preferably replaceable to one of the weight pieces 32*a* to 32*c* of the second weight member 32. Furthermore, a plurality of weight pieces 31*a* to 31*c* of the first weight member 31 may be replaceable to a plurality of the weight pieces 32*a* to 32*c* of the second weight member 32. This makes it possible to offer more variety distribution of the weight to adjust the location of the center of gravity of the head not only in a toe-heel direction but also in a height direction of the head 2.

In the present embodiment, although the second hole 22 is provided at toe side with respect to the first hole 21, the position of the second hole 22 is not particularly limited. For instance, the second hole 22 may be provided at the front or rear side with respect to the first hole 21.

While the particularly preferable embodiments of the present invention have been described in detail, the present invention is not limited to the illustrated embodiments, but can be modified and carried out in various aspects.

What is claimed is:

1. A golf club comprising:

a golf club head provided with a first hole and a second hole on its bottom side;

a shaft detachably fixed to the golf club head;

a shaft sleeve adaptor attached to a tip end of the shaft and having a bottom surface provided with a threaded hole extending from the bottom toward the shaft;

a weight member comprising a first weight member and a second weight member each detachably fixed to the golf club head; and fasteners comprising a first fastener for fixing the shaft and the first weight member to the golf club head through the first hole, and a second fastener for fixing the second weight member to the golf club head through the second hole, wherein the first weight member and the second weight member are configured as mutually replaceable weights so that the first weight member is fixed to the second hole using the second fastener and the second weight member is fixed to the first hole using the first fastener, and wherein the first weight member is fixed between the bottom surface of the shaft sleeve adaptor and the first fastener fixed to the threaded hole of the shaft sleeve adaptor.

2. The golf club according to claim 1, wherein the first fastener and the second fastener are configured as mutually replaceable fasteners so that the first fastener fixes the second weight member through the second hole and the second fastener fixes the first weight member and the shaft through the first hole.

3. The golf club according to claim 1, wherein the golf club head further comprises a hosel provided with a shaft insertion hole that comprises an upper opening for insertion of the shaft into the golf club head and a lower opening that opens on the bottom side, and wherein the first hole comprises a space extending upwardly from the lower opening of the shaft insertion hole toward the threaded hole of the shaft sleeve adaptor.

4. The golf club according to claim 1, wherein each of the first weight member and the second weight member has a through hole for insertion of the first and second fastener.

5. The golf club according to claim 1, wherein each of the first weight member and the second weight member comprises a plurality of weight pieces.

6. The golf club according to claim 1, wherein at least one of the first weight member and the second weight member comprises a pair of weight pieces that have the same shape but different in mass.

7. The golf club according to claim 1, wherein a plurality of the weight pieces of the first weight member are replaceable to a plurality of the weight pieces of the second weight member.

8. The golf club according to claim 1, wherein the first fastener has mass different from that of the second fastener.

9. A golf club comprising:

a golf club head provided with a first hole and a second hole on its bottom side;

a shaft detachably fixed to the golf club head;

a shaft sleeve adaptor attached to a tip end of the shaft and having a bottom surface provided with a threaded hole extending from the bottom toward the shaft;

a weight member comprising a first weight member and a second weight member each detachably fixed to the golf club head; and fasteners comprising a first fastener for fixing the shaft and the first weight member to the golf club head through the first hole and a second fastener for fixing the second weight member to the golf club head through the second hole, wherein the first weight member and the second weight member are configured as mutually replaceable weights so that the first weight member is fixed to the second hole using the second fastener and the second weight member is fixed to the first hole using the first fastener, and wherein the first weight member is fixed between the bottom surface of the shaft sleeve adaptor and the first fastener fixed to the threaded hole of the shaft sleeve adaptor, the first fastener and the second fastener are configured as mutually replaceable fasteners so that the first fastener fixes the second weight member through the second hole and the second fastener fixes the first weight member and the shaft through the first hole, and the first fastener has mass different from that of the second fastener.

* * * * *